US005809151A

United States Patent [19]

Husung

[11] Patent Number: 5,809,151

[45] Date of Patent: Sep. 15, 1998

[54] HEARING AID

[75] Inventor: Kunibert Husung, Erlangen, Germany

[73] Assignee: Siemens Audiologisch Technik GmbH, Erlangen, Germany

[21] Appl. No.: 840,884

[22] Filed: Apr. 17, 1997

[30] Foreign Application Priority Data

May 6, 1996 [DE] Germany ..... 296 08 215.5

[51] Int. Cl.[6] ..... H04R 25/00

[52] U.S. Cl. ..... 381/69; 381/68

[58] Field of Search ..... 381/68, 68.2, 68.3, 381/68.4, 68.5, 68.6, 68.7, 69, 69.1, 69.2, 23.1; 455/300

[56] References Cited

U.S. PATENT DOCUMENTS 2,327,320 8/1943 Shapiro ..... 381/69.1

5,640,457 6/1997 Gnecco et al. ..... 381/69

FOREIGN PATENT DOCUMENTS 06 660 642 12/1994 European Pat. Off. .

PS43 43 702 3/1995 Germany .

0064443 5/1980 Japan ..... 455/300

*Primary Examiner*—Huyen Le

*Attorney, Agent, or Firm*—Hill & Simpson

[57] ABSTRACT

In order to improve the electromagnetic compatibility strength in a hearing aid and for particularly protecting the active components of the amplification and transmission circuit of the hearing aid, the integrated for the amplification and transmission circuit is provided with a shielding that forms a line trap against radio-frequency signals.

11 Claims, 1 Drawing Sheet

HEARING AID

BACKGROUND OF THE INVENTION

1. Field of the Invention

The present invention is directed to an electrical hearing aid of the type having a housing containing at least one microphone, an amplification and transmission circuit fashioned as an integrated circuit (IC), an earphone and a voltage source.

2. Description of the Prior Art

Parasitic electromagnetic emission is demodulated in the active components of an electronic hearing aid circuit. The low-frequency disturbance signal can then lead to failure of or a non-optimum functioning of, the overall electronic hearing aid.

For electromagnetically shielding a hearing aid device against radio signals from foreign transmitter devices, such as e.g. mobile radio devices, car telephones, microwave radiation devices or other RF transmitters, German OS 43 43 702, corresponding to co-pending U.S. application Ser. No. 08/742,556 ("Hearing Aid to Be Worn at the Head," Meyer) assigned to the same assignee as the present application, discloses a shielding for the hearing aid housing whereby the hearing aid device housing is formed from at least two electrically conductive parts that can be connected in electrically conductive fashion via a radio-frequency seal. Since the hearing aid device housing also has openings for the sound entry and sound exit, as well as through-openings for switches means, potentiometers, regulators programming plugs, and the like, and also has a battery drawer which can be opened or an accessible battery compartment, a complete electromagnetic shielding of the housing still poses various problems.

German OS 43 43 703 discloses a hearing aid device wearable at the head which has a housing containing an amplifier circuit that has at least a microphone, an earphone and a battery, and at least one protective means, fashioned as an electrically conductive shielding of the amplifier circuit against radio-frequency electromagnetic waves. The protective means for radio frequency has a conductive connection to an electrical terminal of the amplifier circuit, and electrical means are provided in the conductive connection that form an electrical resistance for the radio frequency signals.

SUMMARY OF THE INVENTION

An object of the present invention is to provide particular protection for the amplification and transmission circuit in a hearing aid of the type generally described above, the circuit being affected in its functioning by disturbing radio-frequency signals.

In accordance with the principles of the present invention, the above object is achieved in a hearing aid wherein the integrated circuit in which the amplifier and transmission circuit is integrated is provided with a shielding that forms a line trap (radio-frequency block) and protects the active components of the amplification and transmission circuit against radio-frequency electromagnetic emission from exterior sources.

By means of the line trap in the IC or the chip for the amplification and transmission circuit, the line-conducted radio frequency emitted by an RF disturbing radiation source is prevented from being able to penetrate into the integrated circuit of the hearing aid. In the inventive hearing aid, a considerable increase in the electromagnetic compatibility strength of the hearing aid is thereby achieved. The integrated hearing aid circuit, in which almost all the active components of the entire hearing aid circuit are located, is completely enclosed by a highly permeable conductive cage. The terminals of the ICs are simply guided individually through the shell core of the cage, or through bores in the IC shielding. In this way, a line trap is formed against the RF disturbing radiation. Each IC terminal is thereby provided with an inductance that prevents line-conducted radio frequency from being able to penetrate into the amplification and transmission circuit of the hearing aid.

DESCRIPTION OF THE PREFERRED EMBODIMENTS

Figure 1:
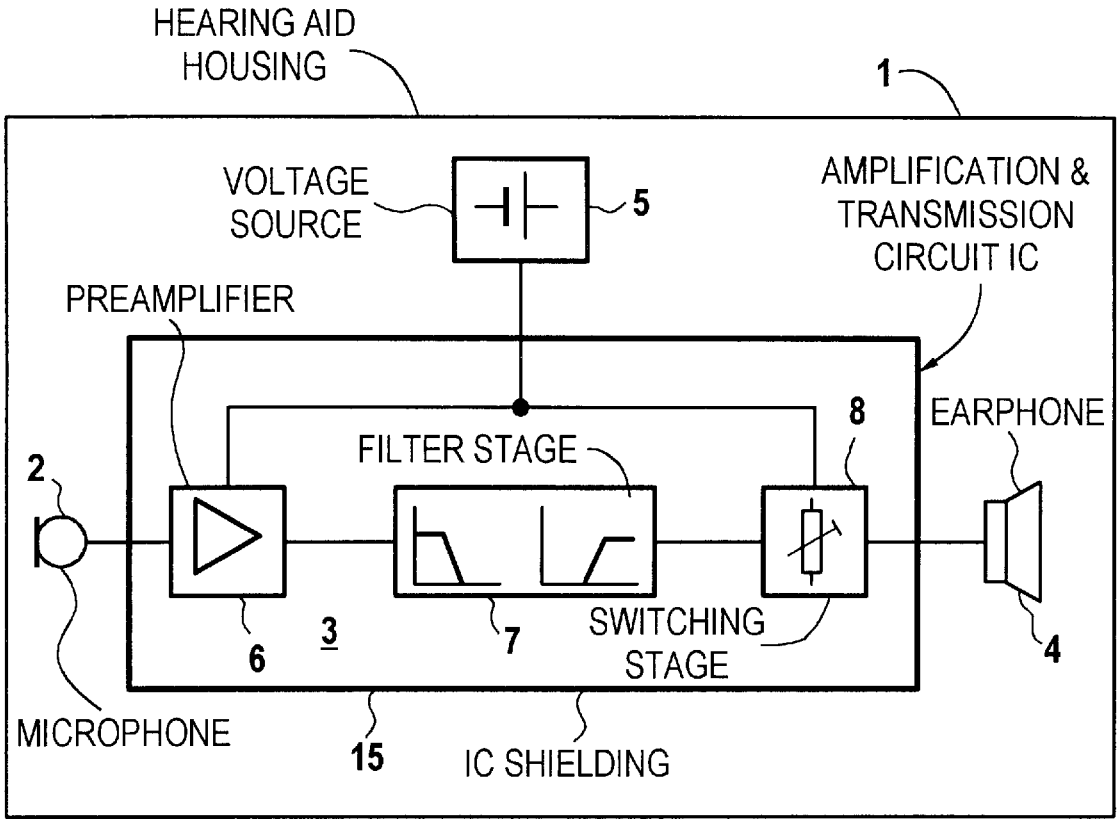
FIG. 1 is a schematic block diagram of an inventive hearing aid having an integrated circuit surrounded by a cage made of a highly permeable material.

The electrical hearing aid according to the invention can be a pocket hearing aid, or a hearing aid that can be worn on the body, or a hearing aid that can be worn at the head, such as a hearing aid that can be worn behind the ear (BTE) or one that can be worn in the ear (ITE). Electrical hearing aids of this sort have a housing 1 containing at least one input audio transducer such as a microphone 2, or one microphone 2 and an induction coil (telephone coil, not shown) or multiple microphones. In the hearing aid according to FIG. 1, an output audio transducer such as an earphone 4 is also arranged in the hearing aid housing 1, whereby an amplification and transmission circuit 3, fashioned as an IC or chip, is located in the signal path between the audio transducers 2 and 4. The circuit 3 includes, for example, a pre-amplifier 6, a signal filter stage 7 and a switching stage 8 for setting the amplification (volume control). A voltage source 5, e.g. a battery or accumulator, likewise provided in the housing 1, serves to supply energy to the audio transducers 2 and 4 and to the active additional components 6, 7, 8, etc., of the circuit 3.

In order to increase the electromagnetic compatibility strength, in the hearing aid device according to the embodiment in FIG. 1 the IC for the circuit 3 is provided with a shielding 15 that forms a line trap and protects the active components 6, 7, 8 of the amplification and transmission circuit 3 against radio-frequency electromagnetic radiation.

The shielding 15 for the IC for the circuit 3 is preferably a cage of highly permeable material that encloses the IC. The IC shielding 15 can, for example, be a metallic cage, a metal foil sheath, a coating of conductive varnish, a plastic sheath with embedded conductive material, or the like.

According to a different embodiment, the IC for the circuit 3 can be coated with ferrite powder or the like.

Figure 2:
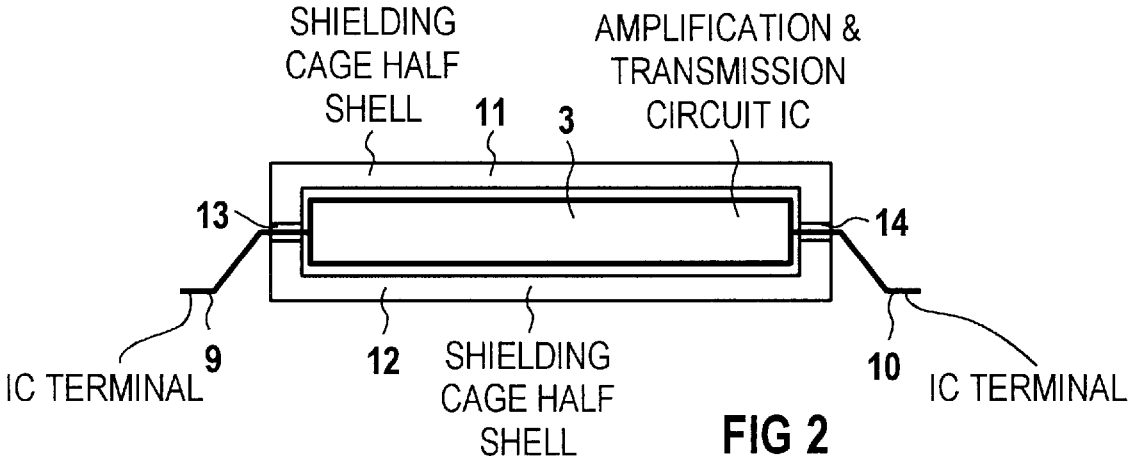
FIG. 2 is a detailed view of a hearing aid IC, with a shielding consisting of a shell upper part and a shell lower part, and with the electrical IC terminals, in accordance with the invention.

FIG. 2 schematically shows an embodiment of an integrated circuit for the amplification and transmission circuit 3 of a hearing aid, with the shielding 15 being formed by shielding cage halves 11 and 12 i.e., a shell upper part and a shell lower part made of highly permeable material. Through-openings 13 and 14 for electrical IC terminals 9 and 10 are provided in the cage halves 11 and 12.

In order to avoid an introduction of RF currents that disturb the amplification circuit and transmission circuit 3 via the electrical terminals 9 or 10 of the IC for the circuit 3, HF filter means, capacitors, resistors or the like can be allocated to these terminals 9 and 10.

Although modifications and changes may be suggested by those skilled in the art, it is the intention of the inventor to embody within the patent warranted hereon all changes and modifications as reasonably and properly come within the scope of his contribution to the art.

I claim as my invention:

1. In an electronic hearing aid having a housing containing at least one audio input transducer and an audio output transducer with a signal path between said input and output audio transducers, an integrated circuit having an amplification and transmission circuit integrated therein in said signal path, and a voltage source connected to each of said input and output audio transducers and said amplification and transmission circuit, the improvement comprising:

shielding means allocated exclusively to and surrounding said integrated circuit between said input and output audio transducers and forming a line trap for protecting said amplification and transmission circuit against externally originating radio-frequency electromagnetic radiation existing inside said housing.

2. The improvement of claim 1 wherein said integrated circuit has a plurality of terminals, and wherein said shielding means comprises means for connecting an inductance to each terminal for preventing penetration of line-conducted radio-frequency currents into said amplification and transmission circuit.

3. The improvement of claim 1 wherein said shielding means comprises a cage surrounding said integrated circuit consisting of highly permeable conductive material, and wherein said integrated circuit has a plurality of electrical terminals extending through said cage.

4. The improvement of claim 3 wherein said cage comprises an upper shell part and a lower shell part each consisting of said highly permeable conductive material.

5. The improvement of claim 3 wherein said cage comprises a plurality of through-openings through which said terminals respectively proceed.

6. The improvement of claim 1 wherein said shielding means comprises a metallic cage.

7. The improvement of claim 1 wherein said shielding means comprises a metallic foil sheath.

8. The improvement of claim 1 wherein said shielding means comprises a coating of conductive varnish on said integrated circuit.

9. The improvement of claim 1 wherein said shielding means comprises a plastic sheath embedded with conductive material.

10. The improvement of claim 1 wherein said shielding means comprises a ferrite powder coating on said integrated circuit.

11. The improvement of claim 1 wherein said integrated circuit has a plurality of terminals, and further comprising a plurality of radio-frequency filter elements connected to each of said terminals for preventing introduction of radio-frequency currents into said amplification and transmission circuit.

* * * * *